US006698326B2

(12) United States Patent
Elia et al.

(10) Patent No.: US 6,698,326 B2
(45) Date of Patent: Mar. 2, 2004

(54) LOCK-UP SYSTEM FOR CUTTING MAT

(75) Inventors: John Rocco Elia, Arden, NC (US); Jerry Shelton, Fairview, NC (US)

(73) Assignee: Day International, Inc., Dayton, OH (US)

( * ) Notice: Subject to any disclaimer, the term of this patent is extended or adjusted under 35 U.S.C. 154(b) by 146 days.

(21) Appl. No.: 09/840,325

(22) Filed: Apr. 23, 2001

(65) Prior Publication Data

US 2001/0027709 A1 Oct. 11, 2001

(51) Int. Cl.[7] ..... B26D 7/20

(52) U.S. Cl. ..... 83/659; 83/698.31; 83/347; 492/45

(58) Field of Search ..... 83/659, 658, 347, 83/698.42, 698.41, 698.31; 492/40, 45, 48, 56

(56) References Cited

U.S. PATENT DOCUMENTS

| | | | | |
|---|---|---|---|---|
| 3,270,607 A | * | 9/1966 | Oesterreicher | 83/659 |
| 3,522,754 A | | 8/1970 | Sauer | |
| 3,739,675 A | | 6/1973 | Duckett et al. | |
| 3,765,329 A | | 10/1973 | Kirkpatrick et al. | |
| 3,880,037 A | | 4/1975 | Duckett et al. | |
| 3,882,750 A | | 5/1975 | Duckett et al. | |
| 4,031,600 A | | 6/1977 | Whigham | |
| 4,073,207 A | | 2/1978 | Kirkpatrick | |
| 4,075,918 A | | 2/1978 | Sauer | |
| 4,191,076 A | | 3/1980 | Bollmer et al. | |
| 4,240,192 A | | 12/1980 | Davis | |
| 4,240,312 A | | 12/1980 | Ward, Sr. | |
| 4,287,799 A | * | 9/1981 | Fujita et al. | 83/347 |
| 4,378,737 A | | 4/1983 | Kirkpatrick | |
| 4,791,846 A | | 12/1988 | Kirkpatrick | |
| 4,848,204 A | | 7/1989 | O'Conner et al. | |
| 4,867,024 A | | 9/1989 | Cho et al. | |
| 4,982,639 A | | 1/1991 | Kirkpatrick | |
| 5,076,128 A | | 12/1991 | O'Conner et al. | |
| 5,078,535 A | | 1/1992 | Kirkpatrick | |
| 5,219,352 A | * | 6/1993 | Atkinson | 83/678 |
| 5,720,212 A | | 2/1998 | Kirkpatrick | |
| 5,758,560 A | | 6/1998 | Fiscus | |
| 5,906,149 A | * | 5/1999 | Montenegro Criado | 83/659 |
| 5,916,346 A | | 6/1999 | Neal | |
| 6,116,135 A | | 9/2000 | Wagner | |
| 6,135,002 A | | 10/2000 | Neal | |
| 2001/0029812 A1 | | 10/2001 | Kirkpatrick, Jr. | |

FOREIGN PATENT DOCUMENTS

| | | |
|---|---|---|
| GB | 2 288 563 A | 10/1995 |

* cited by examiner

*Primary Examiner*—Kenneth E. Peterson
*Assistant Examiner*—Omar Flores Sánchez
(74) *Attorney, Agent, or Firm*—Killworth, Gottman, Hagan & Schaeff LLP

(57) ABSTRACT

A lockup device for securing cutting mats to a rotary anvil comprises a base portion, one sidewall, and a wedge portion, and is adapted to be inserted into the channel of the rotary anvil such that the sidewall of the lockup device is adjacent a wall of the channel. A cutting mat having opposing first and second flanged ends is wrapped around the rotary anvil. The first flange is compressed between the locking wedge and the sidewall of the lockup device. The second flange is compressed between the locking wedge and a channel wall. As such, the locking wedge and cutting mat are frictionally secured to the rotary anvil. Further, the cutting mat may be quickly repositioned by releasing the second flange from the channel. When the cutting mat is unwrapped from the rotary anvil, the lockup device remains secured to the first flange, allowing for quick repositioning.

28 Claims, 4 Drawing Sheets

LOCK-UP SYSTEM FOR CUTTING MAT

BACKGROUND OF THE INVENTION

The present invention relates in general to a locking device for flexible, annular covers and in particular, to a lockup device for securing a cutting mat to a rotary anvil.

Rotary die cutting machines are used to cut a continuously moving workpiece by passing the workpiece through the nip of two generally cylindrical rotary components, a cutting roller and a rotary anvil. The cutting roller includes any combination of cutting blades or rules, and scoring elements projecting from the surface thereof. The rotary anvil provides a suitable surface to support the workpiece at the point where the work material is cut or scored by the cutting roller. Essentially, the rotary anvil serves as a backstop allowing the cutting blades to be urged against the work material to be cut or scored, without damaging the cutting blades themselves. Because of their speed of operation, rotary die cutting machines are used to perform cutting operations in numerous industries. For example, the corrugated industry utilizes such machines to cut and score corrugated paperboard materials for constructing packaging products such as boxes and shipping containers.

Typically, several cutting mats are axially aligned on a rotary anvil, such that a substantial portion of the rotary anvil is sleeved by the cutting mats. Each cutting mat is constructed of a deformable material such as a polymeric composition. The outer surface of the cutting mat is sufficiently rigid to give adequate support to the work material, yet soft enough so that the cutting blades will not wear or be damaged by impact with the rotary anvil. The rules or cutting blades on the cutting roller penetrate the cutting mats in operation. This leads to eventual fatigue and wear of the cutting mats, requiring periodic replacement.

At times, rotary die cutting machines are set up to feed a workpiece centrally, and as such, the full width of the rotary die cutting machine is not used. Under this circumstance, the cutting mats located generally in the central portion of the rotary anvil experience most of the wear. Likewise, the cutting mats located at the opposing end portions of the rotary anvil receive the least wear. To prolong the life of cutting mats, it is desirable to rotate the relative positions of the cutting mats on the rotary anvil, such that the cutting mats wear more evenly. Typically, a rotary anvil will hold between eight and fourteen cutting mats. Repositioning a number of cutting mats causes considerable downtime. The cutting mats wear continuously during cutting operations. As the cutting mats wear, the quality of the cutting operation deteriorates until the worn cutting mats are replaced. However, because of the considerable downtime in cutting mat rotation and changeover, the industry tendency is to prolong the time between cutting mat changeovers. This leads to a greater possibility of poor quality cuts.

Several techniques have been devised to secure the cutting mat to the rotary anvil. For example, several lockup devices comprise latching mechanisms built into flanged end portions of cutting mats. The flanged ends are interconnected and inserted into a channel of the rotary anvil itself, or in a slip bearing secured to the rotary anvil. In one device, a rotary anvil cover latching assembly includes a cutting mat having a female latch member, and an opposing flanged male latch member. The female latch member comprises a generally U-shaped metal frame having an upper segment, a side segment, and base segment. The rotary anvil includes a slip bearing having a channel extending longitudinally. A groove is provided along the intersection of each sidewall and the base of the channel, defining a pair of locking regions. The female latch member is inserted into the channel, such that the base segment rests on the base of the channel, and an angled end section of the base segment is received into one of the grooves. The mat is wrapped around the rotary anvil, and the flanged, male latch member is angled into the female latch member. However, cutting mats with this type of latch assembly have a tendency to pull away from the surface of the slip bearing and are difficult to mount because of the amount of compression required to force the male member into the final position within the female member. Difficulty in mounting such cutting mats leads to rotary die cutting machine downtime and infrequent cutting mat changeover.

Still other lockup devices comprise complimentary interlocking fingers cut into opposing ends of the cutting mat. Such devices attempt to eliminate the use of flanged end portions of a cutting mat and further eliminate the need for the channel in the rotary anvil. For example, one cutting mat construction comprises opposite ends having a plurality of complimentary fingers and receivers. The cutting mat is wrapped around the rotary anvil, and the ends are joined in puzzle like fashion. However, this construction may not provide suitable holding strength. Further, the ends of the cutting mat may pull away or slightly lift from engagement with each other causing one or more ridges or humps to be formed on the outer surface of the cutting mat. These ridges may interfere with the smooth operation of the rollers and as such, are detrimental to the rotary die cutting procedure. Cutting mats that incorporate interlocking fingers can also be difficult to install and mount leading to press downtime, and infrequent cutting mat changeover.

SUMMARY OF THE INVENTION

The present invention overcomes the disadvantages of previously known locking systems for cutting mats by providing a lockup device that allows for rapid cutting mat changeover, and installation. The lockup device comprises a base portion, one sidewall, and a wedge portion, and is inserted into a channel of a rotary anvil such that the sidewall of the lockup device is adjacent a wall of the channel. A cutting mat having opposing first and second flanged ends is wrapped around the rotary anvil. The first flange is compressed between the locking wedge and the sidewall of the lockup device. The second flange is compressed between the locking wedge and a channel wall. As such, the locking wedge and cutting mat are frictionally secured to the rotary anvil. Further, the cutting mat may be quickly repositioned by releasing the second flange from the channel. When the cutting mat is unwrapped from the rotary anvil, the lockup device remains secured to the first flange, allowing for quick repositioning.

In accordance with one embodiment of the present invention, a lockup device for securing a cutting mat to a rotary anvil is sized and dimensioned to fit within an axially extending channel along the surface of the rotary anvil. The lockup device comprises a base portion having first and second axially extending edges, and first and second transverse edges that correspond generally to the width of the axially extending channel. A sidewall projects from the first axial edge of the base. The height of the sidewall corresponds generally to the depth of the channel. The locking wedge further includes a locking wedge projecting from the base. The lockup device is insertable into the channel of the rotary anvil and is arranged to receive opposing first and second flanges of a cutting mat such that when the lockup device is inserted within the channel, and the opposing first and second flanges are received by the lockup device, the lockup device and the cutting mat are frictionally secured to the rotary anvil.

The locking wedge comprises a leg portion extending from the base. A pair of opposite, angularly outward extending locking surfaces project from the leg portion, and a pair of guide surfaces extend from their respective locking surfaces. The pair of guide surfaces are substantially inverted "V" shaped, each guide surface joining together at a common point. The locking surfaces frictionally hold the flanges of the cutting mat. As such, the locking surfaces may comprise any geometry that is disposed towards holding. For example, the locking surfaces may be arcuate, and comprise surface conditioning such as a knurled surface.

A first locking area is defined between the sidewall and the locking wedge, and a second locking area is defined between the locking wedge and the second axial edge of the base portion. When the lockup device is inserted within the channel, and a cutting mat is installed around the rotary anvil, the first flange of the cutting mat is frictionally held within the first locking area, and the second flange of the cutting mat is frictionally held within the second locking area. To improve the frictional fit of the first flange in the first locking area, the sidewall may comprise a non-uniform thickness, for example by tapering out as the sidewall extends out from the base portion. Further, the second flange is releasable from the second locking area such that when the cutting mat is unwrapped from the rotary anvil, the lockup device releases from the channel with the first flange remaining at least partially secured within the first locking area. This allows rapid replacement and moving of the cutting mats because only the second flange of the cutting mat need be released from the locking wedge in order to remove the cutting mat and the locking wedge from the channel.

The lockup device maintains the cutting mat securely fixed to the rotary anvil by frictional forces only. As such, there are no screws, bolts, or the like to slow down cutting mat changeover. The frictional forces are divided between the cutting mat and the lockup device so that relieving the frictional forces contributed by the cutting mat allows the lockup device to release easily from the channel. Specifically, when the lockup device is inserted within the channel, and the opposing first and second flange are received by the lockup device, the lockup device and the cutting mat are secured to the rotary anvil by frictional forces between the base portion and the channel floor, the side wall of the lockup device and the first channel wall, and the second flange and the second channel wall. By releasing the second flange from the second locking area, the friction retaining the cutting mat and the lockup device is partially relieved, allowing the lockup device to be easily removable from the channel.

In accordance with another embodiment of the present invention, a rotary anvil construction comprises a rotary anvil having a generally cylindrical surface and a channel axially disposed on the cylindrical surface, the channel comprising first and second channel walls projecting inward from the cylindrical surface. A lockup device is insertable into the channel and held therein by frictional forces only. The lockup device comprises a base portion having first and second axial edges, and first and second transverse edges. A sidewall projects from the first axial edge of the base, and a locking wedge projects from the base between the first and second axial edges.

The lockup device is insertable within the channel. A cutting mat has a first end terminating in a first flange, and a second end opposite the first end terminating in a second flange. The cutting mat is wrappable around the cylindrical surface of the rotary anvil such that the first flange is received in, and secured between, the locking wedge and the sidewall, and the second flange is received in, and secured between, the locking wedge and the second channel wall. As such, the lockup device and the cutting mat are frictionally secured to the rotary anvil. Further, upon removing the cutting mat from the rotary anvil by releasing the second flange from the channel and unwrapping the cutting mat, the lockup device releases from the channel, and the first flange remains at least partially secured between the locking wedge and the sidewall.

A plurality of lockup devices and corresponding cutting mats may be axially disposed within the channel, the plurality of lockup devices and cutting mats arranged such that any one of the cutting mats may be released from the rotary anvil without disturbing the remainder of the plurality of cutting mats.

According to yet another embodiment of the present invention, a lockup device for a rotary anvil comprises a base portion having first and second axial edges, and first and second transverse edges. A sidewall having non-uniform thickness projects from the first axial edge of the base, and a locking wedge projects from the base, and is positioned between the first and second axial edges, and spaced closer to the first axial edge than the second axial edge. A first locking area is defined between the sidewall and the locking wedge, and a second locking area is defined between the locking wedge and the second axial edge of the base.

The locking wedge has a cross section comprising a leg portion extending from the base, a pair of opposite, angularly outward extending arcuate, knurled locking surfaces projecting from the leg portion, and, a pair of guide surfaces substantially forming an inverted "V" shape, each guide surface extending from a respective one of the locking surfaces to join together at a common point.

The lockup device is arranged to fit into a channel of a rotary anvil. A first flange of a cutting mat is compressed into the first locking area, and a second flange of the cutting mat is compressed into the second locking area. As such, the lockup device secures the cutting mat to the rotary anvil by frictional forces only.

Accordingly, it is a feature of the present invention to provide a lockup device for securing a cutting mat to a rotary anvil, which is simple in construction and easy to use.

It is further a feature of the present invention to provide a lockup device that is insertable within a channel of a rotary anvil and that can secure a cutting mat to the cylinder portion of a rotary anvil using frictional forces only.

It is still another feature of the present invention to provide a lockup device that allows for quick cutting mat changeover and replacement without disturbing adjacent cutting mats.

Other feature of the present invention will be apparent in light of the description of the invention embodied herein.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals, and in which.

DETAILED DESCRIPTION OF THE PREFERRED EMBODIMENTS

Figure 1:
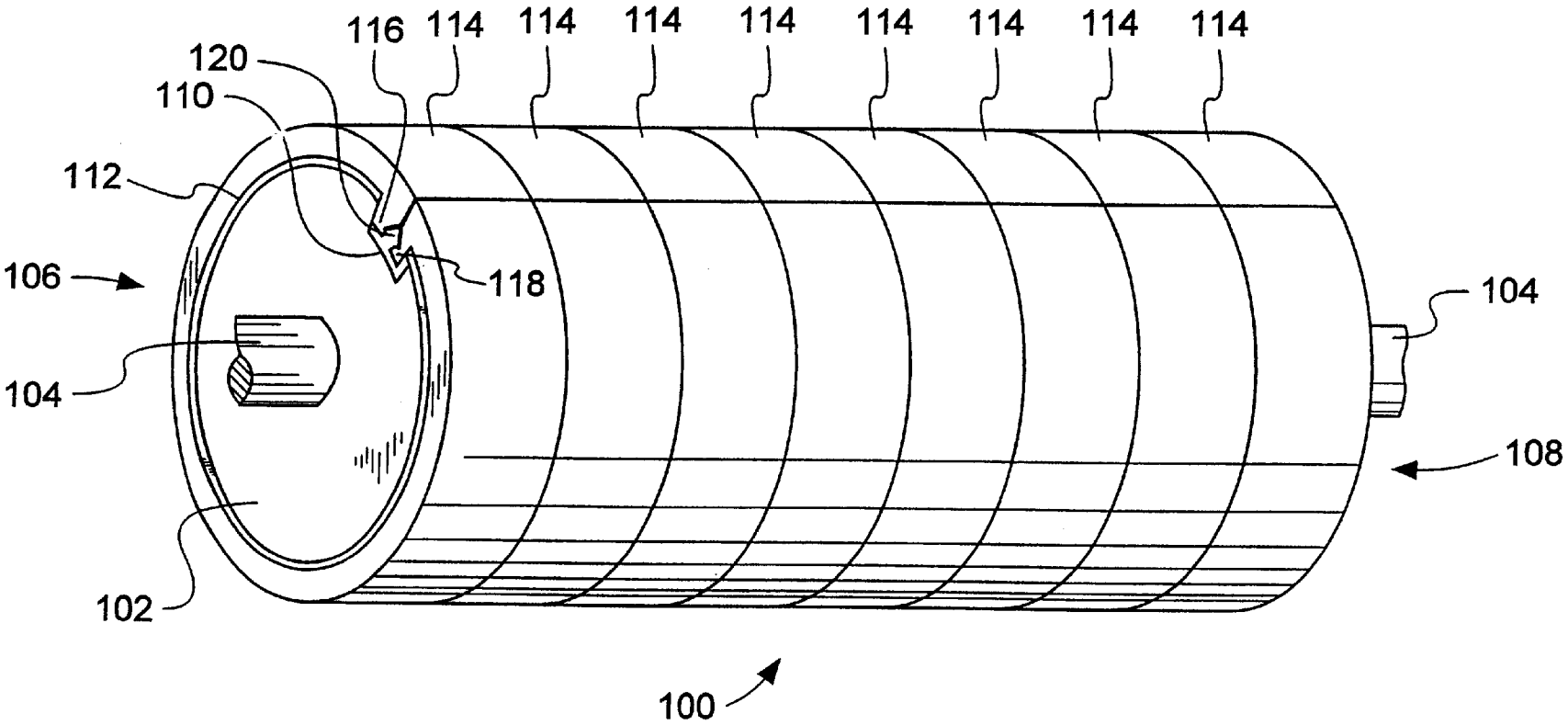
FIG. 1 is a perspective view of a rotary anvil having a plurality of cutting mats wrapped around a cylindrical portion and locked into an axially extending channel.

In the following detailed description of the preferred embodiments, reference is made to the accompanying drawings that form a part hereof, and in which are shown by way of illustration, and not by way of limitation, specific preferred embodiments in which the invention may be practiced. It will be appreciated that these are diagrammatic figures, and that the illustrated embodiments are not shown to scale. Further, like structure in the drawings is indicated with like reference numerals.

Reference is made to FIG. 1 of the drawings that illustrates an exemplary rotary anvil 100. The rotary anvil 100 comprises a generally cylindrical anvil portion 102. A shaft 104 extends from opposite end faces 106, 108 of the anvil portion 102, and is particularly adapted to support the rotary anvil 100 for rotation on associated support bearings (not shown) as is known in the art. A channel 110 extends axially along the surface 112 of the anvil portion 102. Any number of cutting mats 114 are wrapped around the surface 112 of the anvil portion 102 and secured thereto, by engaging opposing first and second flanges 116, 118 of the cutting mat 114 in a lockup device 120 located in the channel 110. The cutting mat 114 comprises a compressible resilient elastomeric material such as a synthetic plastic material, and may include a backing material (not shown). Preferably, the cutting mat 114 comprises polyurethane. The backing material may be any suitable material employed in the art for this purpose such as a woven or non-woven fabric. Lockup device 120 frictionally secures the first and second flanges 116, 118 in the channel 110 thereby securing the cutting mat 114 to the rotary anvil 100 as more fully described herein.

Figure 2:
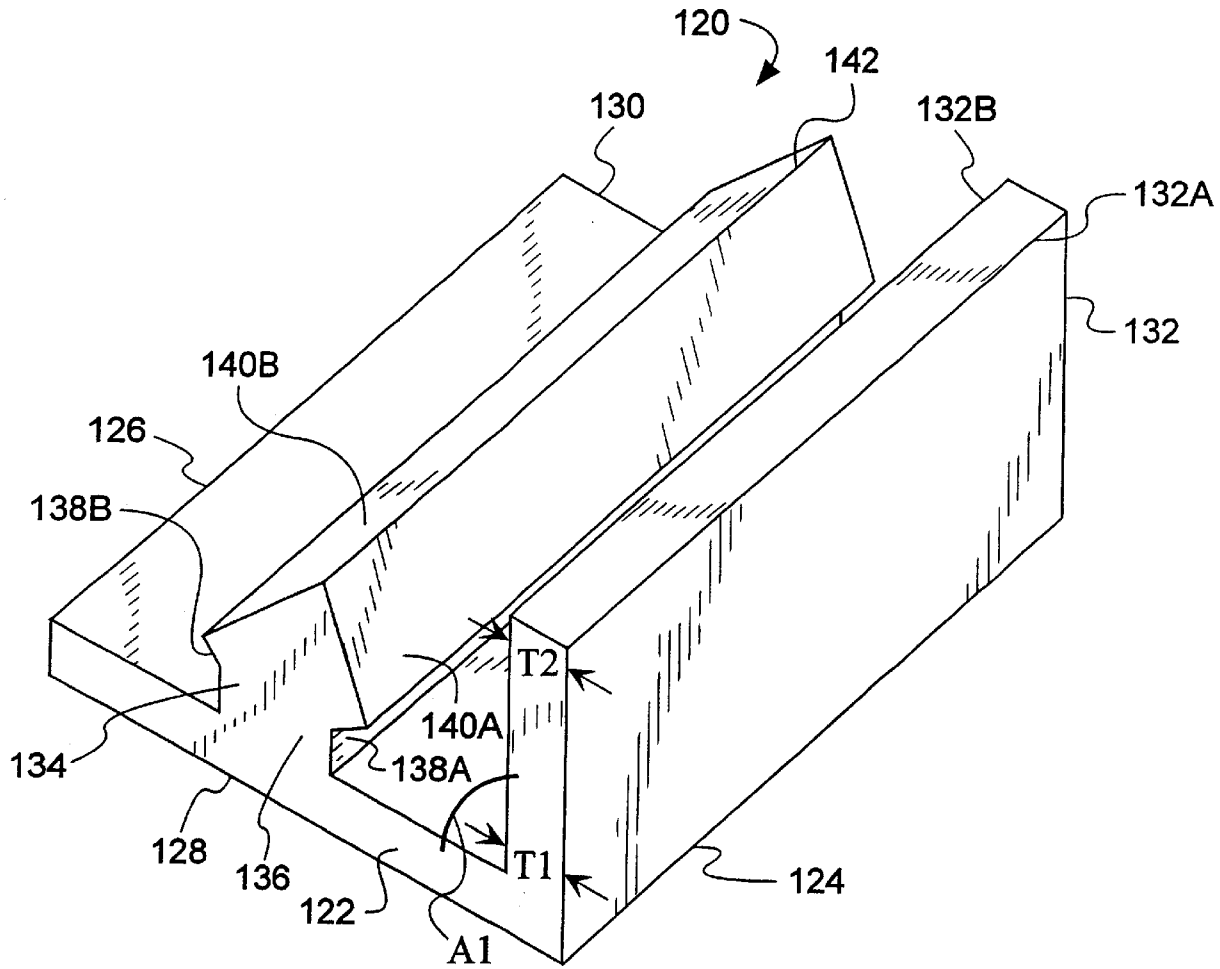
FIG. 2 is a perspective view of the lockup device of FIG. 1.

As best illustrated in FIG. 2, the lockup device 120 comprises a base portion 122 having first and second axial edges 124, 126 and first and second transverse edges 128, 130. A sidewall 132 projects from the base portion 122, disposed along the first axial edge 124. The thickness of the sidewall 132 is preferably non-uniform. As illustrated, the sidewall 132 has a sidewall thickness TI located proximate to the base portion 122, and a second sidewall thickness T2 distal to the base portion 122 such that the thickness T2 is greater than the thickness T1. For example, the sidewall 132 comprises a first surface 132A exterior to the lockup device 120, and a second surface 132B interior to the lockup device 120. The first surface 132A projects normal to the base portion 122. The second surface 132B projects from the base portion 122 at an acute angle A1. The angle A1 is preferably in the range of 80–88 degrees, however, the angle may be adjusted to any angle required to suit the particular application.

A locking wedge 134 projects from the base portion 122, extending axially and generally parallel to the sidewall 132. The locking wedge 134 includes a leg portion 136 extending from the base portion 122 and substantially normal thereto. Opposite, angularly outwardly extending first and second locking surfaces 138A, 138B extend outwardly from opposite sides of the leg portion 136. The first and second locking surfaces 138A, 138B provide additional holding strength and, while illustrated as being substantially planar, may incorporate any geometry conducive to such task. First and second guide surfaces 140A, 140B extend from their respective first and second locking surfaces 138A, 138B and join together defining a substantially inverted "V" shape, joining at a common point 142. The lockup device 120 is preferably constructed from a metal such as aluminum; however other suitable materials may be used such as plastics or composite materials.

Figure 3:
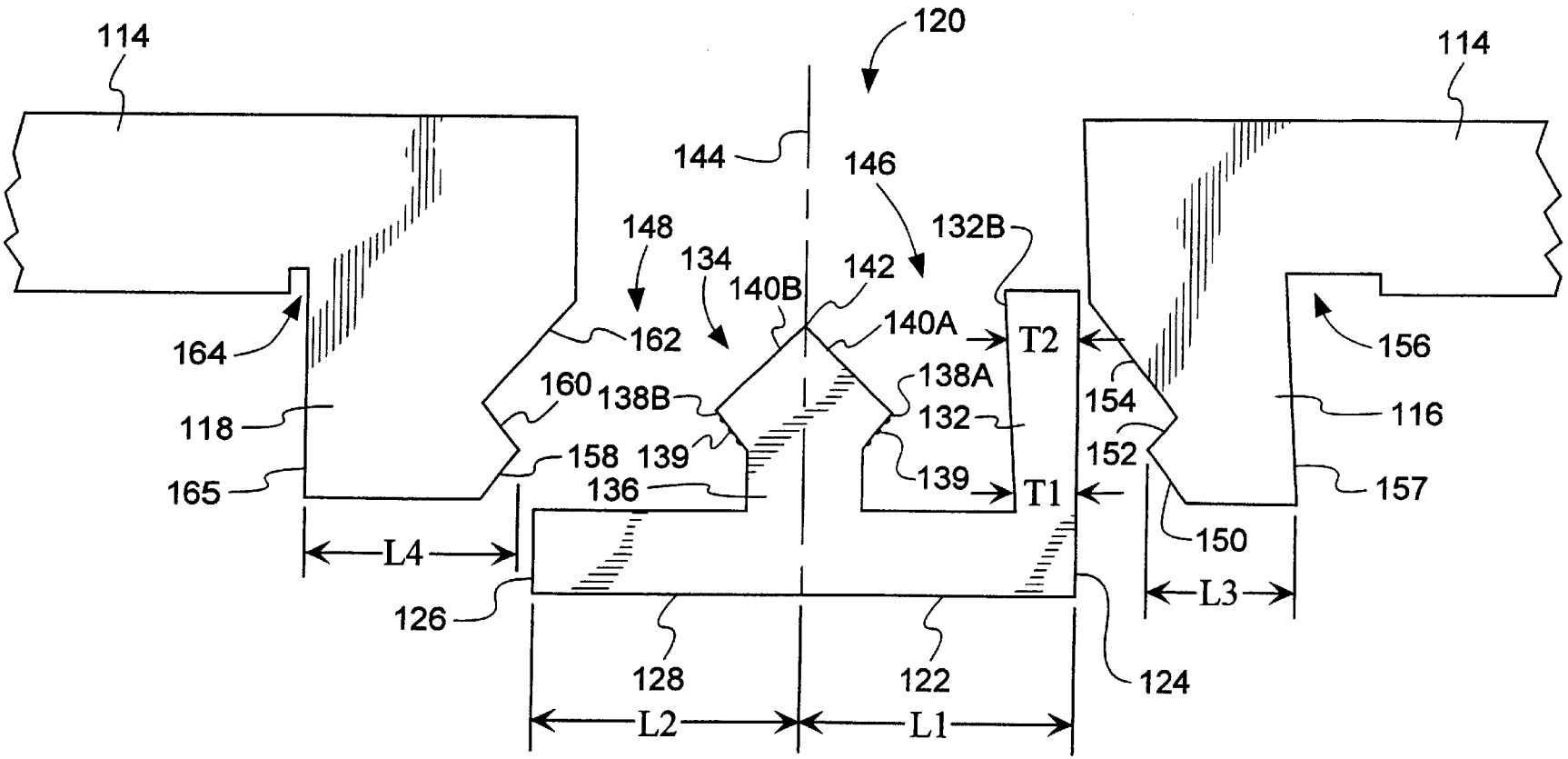
FIG. 3 is an end view of the lockup device of FIG. 1, and opposite flanged ends of a cutting mat according to an embodiment of the present invention.

Referring to FIG. 3, as illustrated, the first and second locking surfaces 138A, 138B and first and second guide surfaces 140A and 140B appear generally symmetrical about axis 144. However, it shall be appreciated by those skilled in the art, that such surfaces may each have unique geometries and need not be symmetrical. Further, as an alternative to substantially planar first and second locking surfaces 138A, 138B as illustrated in FIG. 2, the first and second locking surfaces 138A, 138B are arcuate in shape and may optionally include surface textures 139, such as knurls or similar features for improved grip on first and second flanges 116, 118 of cutting mat 114.

The locking wedge 134 projects from the base portion 122 off-center between the first and second axial edges 124, 126. As illustrated, the locking wedge 134 is positioned a distance L1 from the first axial edge 124 and a distance L2 from the second axial edge. Preferably, the distance L2 is greater than the distance L1. For example, the distance L1 may be 60% of L2. The exact amount of the difference between L1 and L2 may vary depending upon the application, and may include ratios of L1 to L2 greater than or less than 60%. The area generally between the lockup device 120 and the sidewall 132 defines a first locking area 146, and the area generally between the lockup device 120 and the second axial edge 126 of the base portion 122 defines a second locking area 148.

The cutting mat 114 in FIG. 3 illustrates opposing first and second flanges 116, 118. The entirety of the cutting mat 114 is not shown. The first flange 116 includes a first aligning surface 150. The first aligning surface 150 is oriented such that when the first flange 116 is being snap fitted into the lockup device 120, the first aligning surface 150 engages the first guide surface 140A to direct and guide the first flange 116 into the first locking area 146. As the first flange 116 recesses into the first locking area 146, the first holding surface 152 engages the first locking surface 138A of the lockup device 120. Surface 154 is contoured to generally receive the first guiding surface 140A of the lockup device 120 when the first flange 116 is seated in the first locking area 146. A relief channel 156 is provided in the cutting mat 114 to aid in flexibility of the cutting mat 114 and first flange 116. Further, the first flange 116 has a length L3, which is proportional to distance L1 such that when the first flange 116 is compressed into the first locking area 146, the first holding surface 152 engages the first locking surface 138A, and the back surface 157 of the first flange 116 presses against the second surface 132B of the sidewall 132. As such, the first flange 116 is frictionally secured within the first locking area 142.

Likewise, the second flange 118 includes a second aligning surface 158. The second aligning surface 158 is oriented such that when the second flange 118 is being snap fitted into the lockup device 120, the second aligning surface 158 engages the second guide surface 140B to direct and guide the second flange 118 into the second locking area 148. As the second flange 118 recesses into the second locking area 148, the second holding surface 160 engages the second locking surface 138B of the lockup device 120. Surface 162 is contoured to generally receive the second guiding surface 140B of the lockup device 120 when the second flange 118 is seated in the second locking area 148. A relief channel 164 is provided in the cutting mat 114 to aid in flexibility of the cutting mat 114 and second flange 118. Further, the second flange 118 has a length L4 which is proportional to the distance L2 such that when the lockup device 120 is inserted into the channel (not shown in FIG. 3), the second flange 118 is compressed into the second locking area 148, the second holding surface 160 engages the second locking surface 138B, and the back surface 165 of the second flange 118 presses against the channel wall (not shown in FIG. 3).

Figure 4:
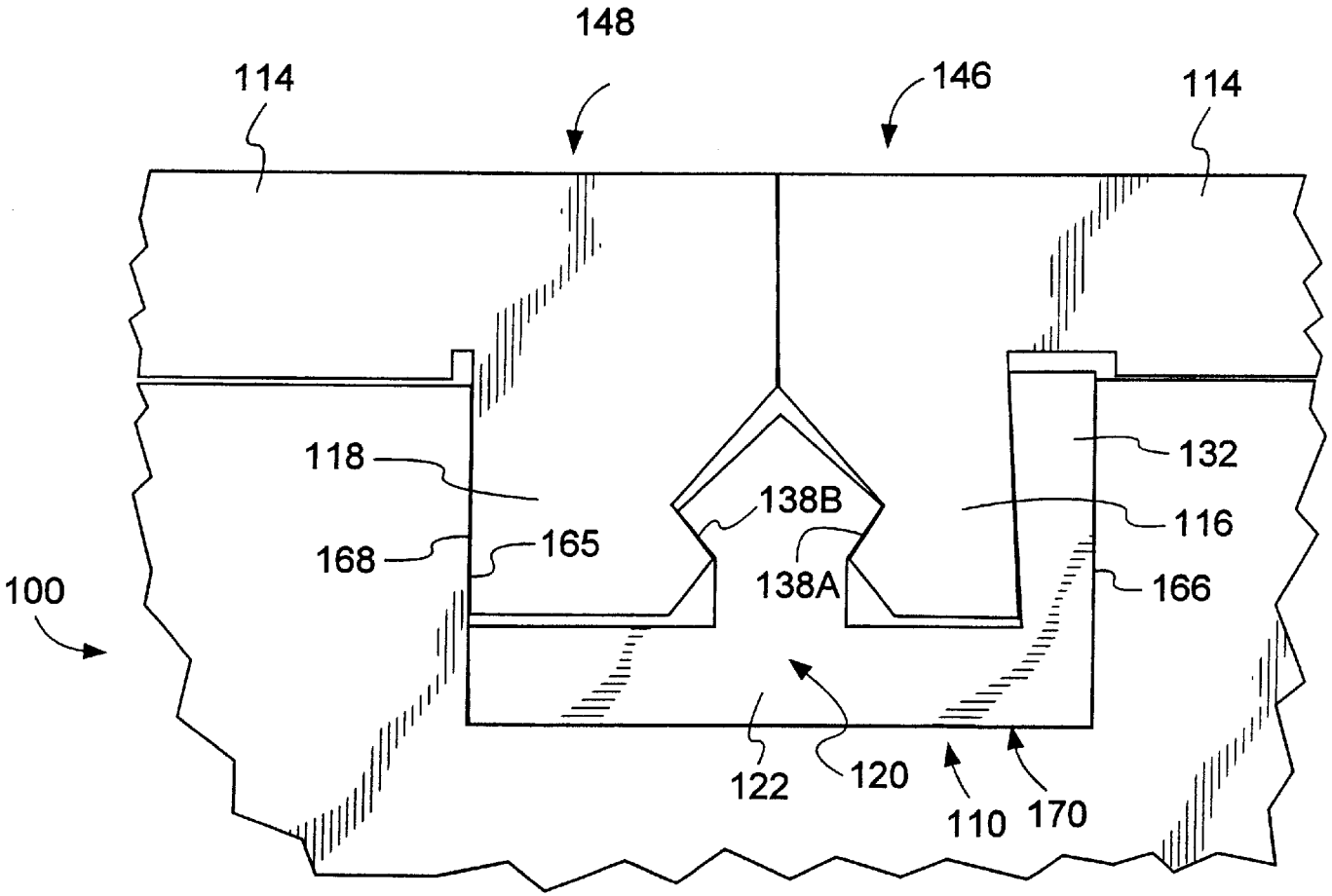
FIG. 4 is an enlarged fragmentary end view of the rotary anvil of FIG. 1 showing the lockup device of FIG. 2 and a cutting mat installed in the axially extending channel.

As shown in FIG. 4, the channel 110 of the rotary anvil 100 comprises first and second channel walls 166, 168 and a channel floor 170. The lockup device 120 is compression fit into the channel 110 such that the base portion 122 of the lockup device 120 rests on the channel floor 170 and the sidewall 132 lies juxtaposed the first channel wall 166. The lockup device 120 is releasably held in the channel 110 by frictional forces only. That is, there are no latching strips, no bolting or gluing. As such, a quick cutting mat changeover time is realized.

The first flange 116 is press fit or snapped into the first locking area 146 as described above, the cutting mat 114 is wrapped around the anvil portion 102 of the rotary anvil 100, and the second flange 118 is press fit or snapped into the second locking area 148. The cutting mat 114 and lockup device 120 are securely held to the rotary anvil 100 by the combination of frictional forces derived from compression fitting the lockup device 120 into the channel 110, and from the frictional forces of the second flange 118 compression fit into the second locking area 148, wherein the back surface 165 of the second flange 118 pushes against the second channel wall 168.

During use, several cutting mats 114 may be axially aligned on the rotary anvil 100 as shown in FIG. 1. Where excess wear is evidenced on one of several cutting mats 114, there is now, no longer a need to grind down or rotate the whole set of cutting mats 114. A user may simply release the worn cutting mat by grasping and pulling on the flanges to release the mat from the lockup device, rotate the mat end for end, and reposition it back in place without disturbing the remainder of the cutting mats. Referring to FIG. 4, a user may pull the second flange 118 from the second locking area 148 thereby partially relieving the frictional forces holding the cutting mat 114 and lockup device 120 in the channel 110. When the second flange 118 is pulled from the second locking area 148, the back surface 165 of the second flange 118 no longer exerts a force against the second channel wall 168. The cutting mat 114 is unwrapped from the rotary anvil 100. The lockup device 120 releases from the channel 110 with the first flange 116 of the cutting mat 114 at least partially held in the first locking area 146. The cutting mat 114 is repositioned as desired, the locking wedge is compression fit back into the channel 110, the cutting mat is wrapped once again around the anvil portion 102 and the second flange 118 is snapped back into the second locking area 148. Alternatively, both the first and second flanges 116, 118 may be released from the lockup device 120, leaving the lockup device 120 positioned within the channel 110.

Referring back to FIG. 3, as can now be seen, the second flange 118 is typically the end of the cutting mat 114 snap fitted into the channel 110 after the first flange 116 has been fit into place. As such, the length L4 of the second flange 118 preferably exceeds the length L3 of the first flange 116, to provide a large surface to snap into place while the cutting mat 114 is under pressure from being wrapped around the rotary anvil 100. Further, there is no sidewall on the lockup device 120 extending from the second axial edge 126 of the base portion 122. Referring again to FIG. 4, it should be appreciated that when the lockup device 120 is compression fit into the channel 110, the second channel wall 168 serves as a holding surface. Further, when the second flange 118 is released from the channel 110, and the cutting mat 114 is unwrapped, the sidewall 132 of the lockup device 120 and the first locking surface 138A maintain a secure hold on the first flange 114. This allows the lockup device 120 to release from the channel 110 while still attached to the cutting mat 114.

Further, as described above, the second flange 118 provides additional compressive force securing the lockup device 120 and the cutting mat 114 to the rotary anvil 100. When the second flange 118 is released from the channel 110, the component of compressive force generated by the second flange 118 pressing against the second channel wall 168 is relieved. This allows the lockup device 120 itself to provide some amount of compressive force less than the total amount of compressive force required to secure both the lockup device 120 and the cutting mat 114 to the rotary anvil 100. As a result, when the second flange 118 is released from the channel 110, the lockup device 120 may release from the channel 110, while still secured to the first flange more easily.

Frequent rotation of cutting mats is known to extend the life of the mat. This is now feasible in a production environment due to the quick and effortless changeover time. Further, because there are no bolts, glue or other fasteners holding the cutting mats 114 in place, it is possible to locate the cutting mats 114 to cover only the area being used for cutting. That is, any one cutting mat 114 is infinitely repositionable within the channel 110. As such, there is no longer a need to cover the entire rotary cylinder 100. Further, a single cutting mat 114 may now be easily removed without disturbing adjacent cutting mats 114.

Having described the invention in detail and by reference to preferred embodiments thereof, it will be apparent that modifications and variations are possible without departing from the scope of the invention defined in the appended claims.

What is claimed is:

1. A lockup device for a rotary anvil having a channel, said lockup device comprising:

a base portion having first and second axial edges, and first and second transverse edges;

a locking wedge projecting from said base; and, a sidewall projecting from said base in spaced relation from said locking wedge such that a first flange of a cutting mat may be frictionally and releasably securable to said lockup device between said locking wedge and said sidewall, wherein said lockup device is further arranged such that there is no other sidewall projecting from said base in spaced relation to said locking wedge sufficient to interfere a second flange of said cutting mat from contacting said locking wedge and a wall of said channel when said lockup device and said cutting mat are installed on said rotary anvil.

2. The lockup device according to claim 1, wherein said lockup device is arranged such that when said lockup device is inserted within a channel of a rotary anvil, said first flange frictionally and releasably presses at least partially against said sidewall and said locking wedge of said lockup device, and said second flange frictionally and releasably presses at least partially against said locking wedge and a wall of said channel.

3. The lockup device according to claim 1, wherein said locking wedge has a cross section comprising:

a leg portion extending from said base;

a pair of opposite, angularly outward extending locking surfaces projecting from said leg portion; and, a pair of guide surfaces, each guide surface extending from a respective one of said locking surfaces.

4. The lockup device according to claim 1, wherein said lockup device is arranged such that when said lockup device is inserted within said channel and said opposing first and second flanges are received by said lockup device, said second flange is releasable from said channel and said lockup device is removable from said channel with said first flange remaining at least partially secured between said locking wedge and said sidewall of said lockup device.

5. A lockup device for a rotary anvil comprising:

a base portion having first and second axial edges, and first and second transverse edges;

a sidewall projecting from said first axial edge of said base; and, a locking wedge projecting from said base, wherein said lockup device is insertable into a channel of a rotary anvil and is arranged to secure opposing first and second flanges of a cutting mat to said channel such that when said lockup device is inserted within said channel and said opposing first and second flanges are received by said lockup device, both said lockup device said second flange of said cutting mat is secured by contacting said locking wedge and a wall of said channel, and and said cutting mat are releasably secured to said rotary anvil by friction forces such that when a select one of said opposing first and second flanges of said cutting mat is released from sad channel, both said cutting mat and said lockup device are releasable from said rotary anvil.

6. The lockup device according to claim 5, wherein said locking wedge is positioned on said base closer to said first axial edge than said second axial edge.

7. The lockup device according to claim 5, wherein said locking wedge has a cross section comprising:

a leg portion extending from said base;

a pair of opposite, angularly outward extending locking surfaces projecting from said leg portion; and, a pair of guide surfaces, each guide surface extending from a respective one of said locking surfaces.

8. The lockup device according to claim 7, wherein said pair of guide surfaces are substantially inverted "V" shaped, each guide surface extending from said respective one of said locking surfaces and joining together at a common point.

9. The lockup device according to claim 7, wherein said locking surfaces are arcuate.

10. The lockup device according to claim 7, wherein said locking surfaces are knurled.

11. The lockup device according to claim 5, wherein the thickness of said sidewall is non-uniform.

12. The lockup device according to claim 5, wherein:

a first locking area is defined between said sidewall and said locking wedge; and, a second locking area is defined between said locking wedge and said second axial edge of said base portion, wherein said lockup device is insertable within said channel of said rotary anvil and arranged to secure said cutting mat to said rotary anvil by frictionally holding said first flange of said cutting mat within said first locking area and frictionally holding said second flange of said cutting mat within said second locking area such that said second flange presses at least partially against a wall of said channel.

13. The lockup device according to claim 12, wherein said lockup device is arranged such that when said lockup device is inserted within said channel and said opposing first and second flanges are received by said lockup device, said second flange is releasable from said second locking area and said lockup device is removable from said channel with said first flange remaining at least partially secured within said first locking area.

14. The lockup device according to claim 5, wherein:

said channel comprises first and second channel walls and a channel floor; and, said base portion and said sidewall are arranged such that when said lockup device is inserted within said channel, and said opposing first and second flanges are received by said lockup device, said lockup device and said cutting mat are secured to said rotary anvil by frictional forces between said base portion and said channel floor, said side wall and said first channel wall, and said second flange and said second channel wall.

15. A rotary anvil construction comprising:

a rotary anvil having a generally cylindrical surface and a channel axially disposed on said cylindrical surface, said channel comprising first and second channel walls projecting inward from said cylindrical surface;

a lockup device in said channel and held therein by frictional forces, said lockup device comprising:

a base portion having first and second axial edges, and first and second transverse edges;

a sidewall projecting from said first axial edge of said base arranged such that when said lockup device is inserted in said channel, said sidewall is juxtaposed said first channel wall; and, a locking wedge projecting from said base; and, a cutting mat having a first end terminating in a first flange, and a second end opposite said first end terminating in a second flange, said cutting mat being wrapped around said cylindrical surface of said rotary anvil such that said first flange is received in, and secured by said locking wedge and said sidewall, said second flange is received in, and secured by said locking wedge and said second channel wall, and said lockup device and said cutting mat are frictionally secured to said rotary anvil.

16. A rotary anvil construction according to claim 15, wherein said cutting mat comprises a polyurethane material.

17. A rotary anvil construction according to claim 15, wherein said first flange is received between said locking wedge and said sidewall such that, upon removing said cutting mat from said rotary anvil, said lockup device releases from said channel, and said first flange remains at least partially secured between said locking wedge and said sidewall.

18. A rotary anvil construction according to claim 15, further comprising a plurality of lockup devices and corresponding cutting mats axially disposed within said channel, said plurality of lockup devices and cutting mats arranged such that any one of said cutting mats may be released from said rotary anvil without disturbing the remainder of said plurality of cutting mats.

19. A rotary anvil construction according to claim 15, wherein said locking wedge is positioned on said base closer to said first axial edge than said second axial edge, and said second flange is thicker than said first flange such that when said cutting mat and said lockup device are installed in said channel of said rotary anvil, said first flange is compressed between said locking wedge and said sidewall, and said second flange is compressed against said locking wedge and said second channel wall.

20. A rotary anvil construction according to claim 15, wherein:

said locking wedge has a cross section comprising a leg portion extending from said base, a pair of opposite, angularly outward extending locking surfaces projecting from said leg portion, and a pair of guide surfaces, each guide surface extending from a respective one of said locking surfaces and joining together at a common point defining a substantially inverted "V" shape; and, said first and second flanges of said cutting mat comprise holding surfaces complimentary to said locking surfaces of said locking wedge, and aligning surfaces complimentary to said guiding surfaces of said locking wedge.

21. A rotary anvil construction according to claim 20, wherein said locking surfaces are arcuate.

22. The locking mechanism according to claim 20, wherein said locking surfaces are knurled.

23. The locking mechanism according to claim 15, wherein the thickness of said sidewall is non-uniform.

24. A rotary anvil construction according to claim 15, wherein said cutting mat further comprises an area of relief recessed into the back of said cutting mat, adjacent each said first and second flanges.

25. A lockup device for a rotary anvil comprising:

a base portion having first and second axial edges, and first and second transverse edges;

a sidewall projecting from said first axial edge of said base; and, a locking wedge projecting from said base spaced closer to said first axial edge than said second axial edge, said locking wedge defining a first locking area between said sidewall and said locking wedge, and a second locking area between said lacking wedge and said second axial edge of said base, and wherein said locking wedge has a cross section comprising:

a leg portion extending from said base;

a pair of opposite, angularly outward extending locking surfaces projecting from said leg portion; and, a pair of guide surfaces extending from a respective one of said locking surfaces to join together at a common point, wherein said lockup device is arranged to fit into a channel of a rotary anvil and receive a first flange of a cutting mat compressed into said first locking area, and receive a second flange of said cutting mat compressed into said second locking area so as to press between said locking wedge of said lockup device and a wall of said channel in said rotary anvil, said lockup device securing said cutting mat to said rotary anvil by frictional forces only.

26. The lockup device according to claim 5, wherein only one sidewall extends from said base portion.

27. The lockup device according to claim 5, wherein said cutting mat and said lockup device are releasably held to said channel by the combination of frictional forces between said channel and said lockup device, frictional forces between said lockup device and said cutting mat, and frictional forces between said cutting mat and said channel.

28. The lockup device according to claim 5, wherein at least a portion of a back surface of said second flange of said cutting mat pushes directly against a wall of said channel.

* * * * *

UNITED STATES PATENT AND TRADEMARK OFFICE

CERTIFICATE OF CORRECTION

PATENT NO. : 6,698,326 B2
DATED : March 2, 2004
INVENTOR(S) : Elia et al.

It is certified that error appears in the above-identified patent and that said Letters Patent is hereby corrected as shown below:

Column 9,

Lines 23-24, "by said lockup device, both said lockup device said second flange of said cutting mat is secured by contracting said locking wedge and a wall of said channel, and and said cutting mat are releasably secured to said rotary anvil by friction forces such that when a select one of said opposing first and second flanges of said cutting mat is released from sad channel, both said" should read --by said lockup device, said second flange of said cutting mat is secured by contacting said locking wedge and a wall of said channel, and both said lockup device and said cutting mat are releasably secured to said rotary anvil by frictional forces such that when a select one of said opposing first and second flanges of said cutting mat is released from said channel, both said--.

Signed and Sealed this

Thirtieth Day of November, 2004

JON W. DUDAS
*Director of the United States Patent and Trademark Office*